US008708167B2

(12) United States Patent
Mone

(10) Patent No.: US 8,708,167 B2
(45) Date of Patent: Apr. 29, 2014

(54) COMBINATION GUITAR AND AMPLIFIER STAND

(75) Inventor: Ryan Charles Mone, DeWitt, NY (US)

(73) Assignee: TriVantage Solutions, LLC, Dewitt, NY (US)

( * ) Notice: Subject to any disclaimer, the term of this patent is extended or adjusted under 35 U.S.C. 154(b) by 175 days.

(21) Appl. No.: 13/087,004

(22) Filed: Apr. 14, 2011

(65) Prior Publication Data

US 2011/0253655 A1 Oct. 20, 2011

Related U.S. Application Data

(60) Provisional application No. 61/342,415, filed on Apr. 15, 2010.

(51) Int. Cl.
*A47F 7/00* (2006.01)

(52) U.S. Cl.
USPC ..... 211/85.6

(58) Field of Classification Search
USPC ..... 211/85.6, 13.1, 85.7, 60.1, 67, 68, 64, 211/62, 39, 196, 205, 189, 195; 84/327, 84/453, 329, 421, 293, 267–269, 274, 84/280; 248/146, 152, 174, 176.1, 346.01
See application file for complete search history.

(56) References Cited

U.S. PATENT DOCUMENTS 2,550,793 A 5/1951 Ferriera
2,793,426 A 5/1957 Lamb et al.
2,903,219 A 9/1959 Ingham
4,561,339 A 12/1985 Jensen
4,684,091 A 8/1987 Moreschi
4,728,066 A * 3/1988 Lang et al. ..... 248/165
4,753,408 A 6/1988 Wailes
4,754,711 A 7/1988 Solomon
4,757,544 A * 7/1988 Guy ..... 381/387
4,832,299 A * 5/1989 Gorton et al. ..... 248/231.71
4,882,760 A * 11/1989 Yee ..... 381/335
5,029,796 A * 7/1991 Schoenig ..... 248/443
5,190,254 A 3/1993 Maguire
5,313,866 A 5/1994 Smith (Continued)

OTHER PUBLICATIONS

"Double Guitar Amp Stand", Instructables.com Feb. 2008, http://www.instructables.com/file/FOFSV62FCA43J40 (accessed Sep. 7, 2010).

(Continued)

*Primary Examiner* — Darnell Jayne
*Assistant Examiner* — Hiwot Tefera
(74) *Attorney, Agent, or Firm* — George R. McGuire; Frederick J.M. Price; Bond Schoeneck & King, PLLC

(57) ABSTRACT

A combination guitar and amplifier stand has the ability to hold two guitars and a single 1×12 or 2×12 combination solid state or tube amplifier. The stand has been designed to hold a single piece of equipment without tipping over. The guitar holders allow the user to place their guitars in the holders when not in use. The bottom of the guitar's headstock will rest in the padded holders and the body of the guitar will rest against a padded bar located on the right and left hand side of the rack near the bottom. The amplifier is placed in the rack, located in the middle of the stand and the rack can be adjusted so that the amplifier rack can rest at either a 0° or a 45° angle.

16 Claims, 5 Drawing Sheets

(56) References Cited

U.S. PATENT DOCUMENTS

| | | | | | |
|---|---|---|---|---|---|
| 5,375,497 | A | * | 12/1994 | Pirchio et al. | 84/327 |
| 5,553,717 | A | * | 9/1996 | Minneman et al. | 211/85.7 |
| 5,726,369 | A | * | 3/1998 | Gilday | 84/327 |
| 5,836,552 | A | * | 11/1998 | Yu | 248/166 |
| 5,876,050 | A | | 3/1999 | Berger | |
| 7,164,576 | B2 | * | 1/2007 | Suprapmo et al. | 361/679.55 |
| 7,176,366 | B1 | * | 2/2007 | Bruce | 84/327 |
| 7,514,619 | B1 | * | 4/2009 | Bruce | 84/453 |
| 7,605,318 | B2 | * | 10/2009 | Dover | 84/327 |
| 2002/0118853 | A1 | | 8/2002 | Flentje | |
| 2005/0016354 | A1 | * | 1/2005 | Kent | 84/327 |
| 2009/0025530 | A1 | * | 1/2009 | Dover | 84/327 |

OTHER PUBLICATIONS

"AP-614 Speaker Stand", www.chinaqualitydigital.com, http://www.chinaqualitydigital.com/d-p116511744277818025-ap_614_speaker_stand/ (accessed Sep. 7, 2010).

"On Stage Stands GS7462D", www.alpha-music.com, http://www.alpha-music.com/ProductCart/pc/viewPrd.asp?idproduct=2184&idcategory=0 (accessed Sep. 2010).

"Amplifier/Monitor Tilt Stand—AS3", www.stagelinestands.com, http//www.stagelinestands.com/product-details.cfm?productID=10 (accessed Sep. 7, 2010).

* cited by examiner

Fig. 1
*(PRIOR ART)*
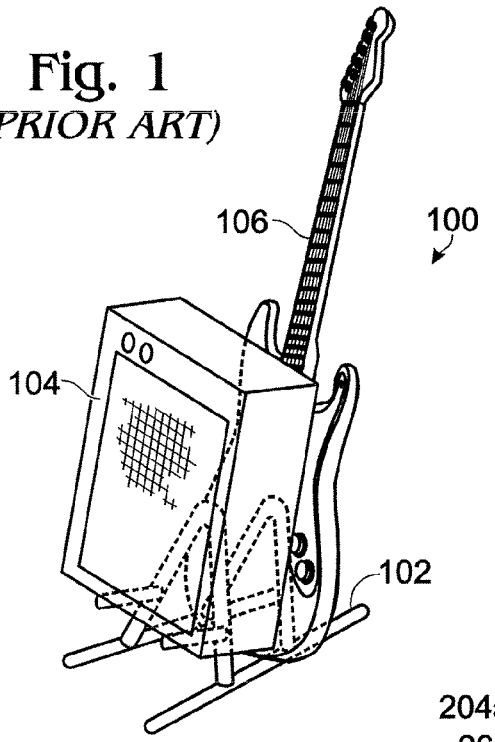
Fig. 3
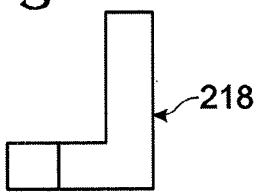
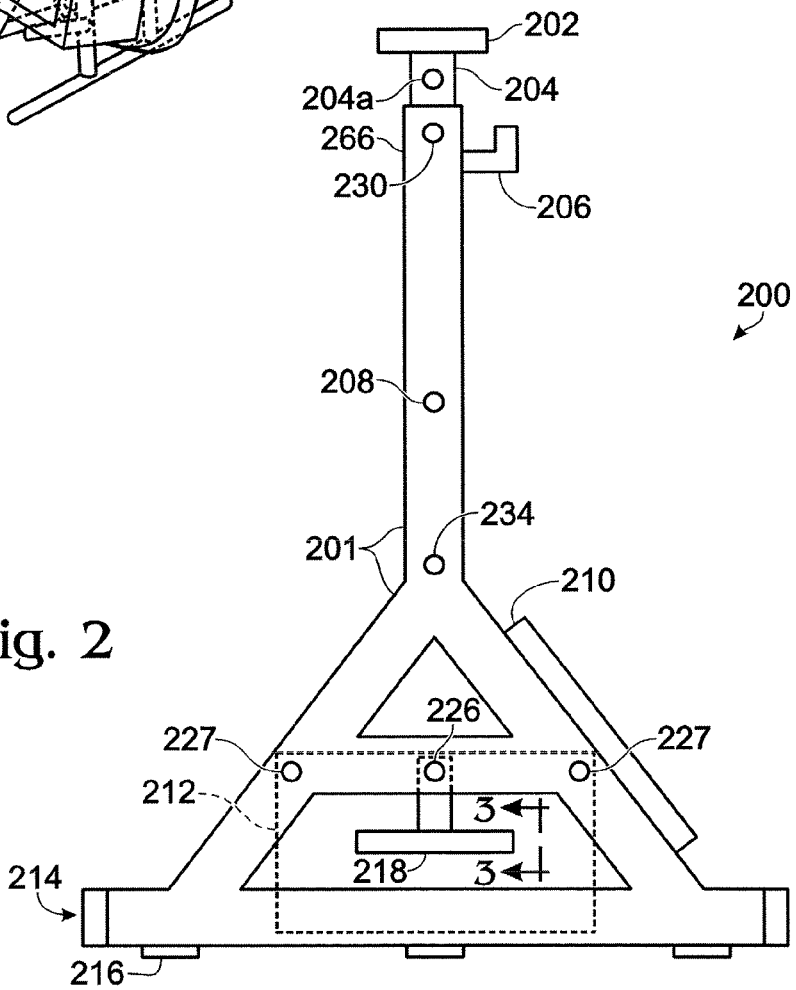
Fig. 2

COMBINATION GUITAR AND AMPLIFIER STAND

RELATED APPLICATION

The present application claims priority to U.S. provisional patent application No. 61/342,415, filed on 15 Apr. 2010; all of the foregoing patent-related document(s) are hereby incorporated by reference herein in their respective entirety(ies).

BACKGROUND OF THE INVENTION

1. Field of the Invention

The present invention relates to guitar stands and amplifier stands and more particularly to combination guitar and amplifier stands.

2. Description of the Related Art

Guitar stands for supporting a guitar (see DEFINITIONS section) up off of the floor, and in a generally vertical position with the instrument body down and the neck extending upwards (herein called an upright vertical position), are known.

Amplifier stands for a supporting amplifier (see DEFINITIONS section) up off of the ground are known. For example, U.S. Pat. No. 4,753,408 ("Wailes") shows an amplifier stand where the angle between the amplifier and the floor is adjustable by the user.

U.S. Pat. No. 5,313,866 ("Smith") shows a special type of guitar stand (herein called an "amplifier-based guitar stand") that mounts to an amplifier and supports a guitar in an upright vertical position. The amplifier-based guitar stand of Smith does not support the amplifier up off of the floor, by merely utilizes the frame of the amplifier as part of the assembly that supports the guitar up off of the floor.

There is a known stand device that can support both a guitar and an amplifier up off of the floor (herein called a "combination guitar and amplifier stand"). This known guitar and amplifier stand is called GS7462 DB Pro A-Frame Double Guitar/Amp Stand (herein called the "GS7462 DB Stand"). The GS7462 DB Stand appears to have been available since 2005. A usage configuration 100 for the GS7462 DB Stand is shown in FIG. 1 and includes GS7462 DB Stand 102; guitar 106; and amplifier 104. While the GS7462 DB Stand can hold two guitars at the same time (specifically, the amplifier can be replaced with an acoustic guitar), it cannot hold two guitars and an amplifier at the same time.

The following published documents may also include helpful background information: ((i) U.S. Pat. No. 2,550,793 ("Ferriera"); (ii) U.S. Pat. No. 2,793,426 ("Lamb"); (iii) U.S. Pat. No. 2,903,219 ("Ingham"); (iv) U.S. Pat. No. 4,561,339 ("Jensen"); (v) U.S. Pat. No. 4,684,091 ("Moreschi"); (vi) U.S. Pat. No. 4,753,408 ("Wailes"); (vii) U.S. Pat. No. 4,754,711 ("Solomon"); (viii) U.S. Pat. No. 5,190,254 ("Maguire"); (ix) U.S. Pat. No. 5,313,866 ("Smith"); (x) U.S. Pat. No. 5,876,050 ("Berger"); (xi) U.S. Patent Publication No. 2002/0118853 ("Flentje"); (xii) U.S. Patent Publication No. 2005/0016354 ("Kent"); (xiii) "Double Guitar Amp Stand", www.Instructables.com, February 2008, http://www.instructables.com/file/F0FSV62FCA43J4O, as of Sep. 7, 2010; (xiv) "AP-614 Speaker Stand", www.chinaqualitydigital.com, http://www.chinqualitydigital.com/dp116511744277818025-ap__614_speaker_stand/, as of Sep. 7, 2010; (xv) "On Stage Stands GS7462D", www.alpha-music.com, http://www.alpha-music.com/ProductCart/pc/viewPrd.asp?idproduct=2184&idcategory=0, as of Sep. 7, 2010; (xvi) "Amplifier/Monitor Tilt Stand—AS3", www.stagelinestands.com, http://stagelinesstands.com/product-details.cfm?productID=10, as of Jul. 19, 2005.

Description of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

BRIEF SUMMARY OF THE INVENTION

The present invention is directed to a combination guitar and amplifier stand that supports both: (i) an amplifier; and (ii) at least guitar, with the at least one guitar being supported at a lateral side of the amplifier. As used herein, the term "lateral side" shall mean a horizontal direction that is approximately 90 degrees apart from the direction, taken in the horizontal plane, that the amplifier speaker side faces. By "direction, taken in the horizontal plane, that the amplifier speaker side faces," what is meant is that the amplifier may be inclined relative to the vertical direction, but its "lateral sides" will still face horizontally even if the speaker side of the amplifier does not face in a horizontal direction. In some preferred embodiments of the present invention the combination guitar and amplifier stand will support at least two guitars, with at least one of the two being located on each lateral side of the amplifier.

Preferably each set of guitar support hardware includes a headstock support and a guitar body bottom support, and the supports are sized, shaped, structured and/or located to hold the guitar in a generally upright position. Preferably, the amplifier may be a single 1×12 or 2×12 combination solid state or tube amplifier. Preferably, the stand is sized, shaped and/or structured to resist tipping even if holding a single guitar (with no amplifier and no second guitar on the opposite lateral side. Preferably, the hardware for holding the amplifier is sized, shaped, structured and/or located so that no additional hardware or accessories are required to secure the amplifier. Preferably, the hardware for holding the amplifier is sized, shaped, structured and/or located so that the amplifier may be adjustably rotated, about a rotational axis that is parallel to its speaker side. Preferably, the combination stand further includes a storage box that can be used to hold small accessories for use with the guitars and/or amplifier.

According to another aspect of the present invention, a guitar stand includes: (i) two guitar body bottom supports; and (ii) two removable headstock supports that are detachably attached to two headstock support receiving hardware sets built into the main body of the guitar stand. Other components may be inserted in place of the headstock supports, such as a guitar workbench or a music stand. Preferably, guitar stands according to this aspect of the present invention further include amplifier support hardware to additionally support an amplifier. Preferably, the headstock supports are each adjustable in their vertical position so that guitars having different vertical dimensions may be reliably supported by both the headstock support and the guitar body bottom support.

Various embodiments of the present invention may exhibit one or more of the following objects, features and/or advantages:

(i) combination guitar and amplifier stands designed with the guitar player in mind for use in a home studio;

(ii) utilizing a single rack to hold the users equipment and accessories minimizes the amount of space need to store two (2) guitars, one (1) amplifier and various accessories;

(iii) consolidation of the user's equipment and accessories into a single area;

(iv) elimination of the need for four (4) individual pieces of equipment (specifically, two guitar stands, an amplifier rack and a storage box for accessories);

(iv) set up time, prior to playing, is greatly reduced since all of the equipment is stored in a single rack;

(v) the user can quickly and easily "rack" her guitars, between sessions or during a break, with a single hand since no additional accessories or hardware is needed to secure either one of the guitars;

(vi) stands designed for the home studio setting that can also be used in other settings, such as playing out, since the stand is light weight and can be quickly and easily dissembled and re-assembled;

(vii) consolidates separate pieces of equipment into a single unit;

(viii) reduces amount of space required to store music-related equipment; and/or (ix) can reduce cost relative to the cost of separate pieces of equipment that would otherwise be required to provide equivalent functionality.

According to a first aspect of the present invention, a musical equipment holding assembly is for use with a first guitar and an amplifier defining a speaker side and first and second lateral sides. The assembly includes: a frame; a first guitar holding hardware set; and an amplifier holding hardware set. The amplifier holding hardware set is sized, shaped, structured and/or located to support the amplifier. The first guitar holding hardware set is sized, shaped, structured and/or located to support the first guitar. The first guitar holding hardware set and the amplifier holding hardware set are each connected to the frame so that when an amplifier is present in the amplifier supporting software, the first guitar holding set is located on the first lateral side of the amplifier.

According to a further aspect of the present invention, a musical equipment holding assembly is for use with a first headstock guitar (see DEFINITIONS section), a second headstock guitar and an amplifier defining a speaker side and first and second lateral sides. The assembly includes: a frame; a first guitar holding hardware set; a second guitar holding hardware set; and an amplifier holding hardware set. The first guitar holding hardware set includes a first headstock support member and a first bottom support member. The first guitar holding hardware set is sized, shaped, structured and/or located to support the first guitar in a generally upright position. The second guitar holding hardware set includes a second headstock support member and a second bottom support member. The second guitar holding hardware set is sized, shaped, structured and/or located to support the second guitar in a generally upright position. The amplifier holding hardware set is sized, shaped, structured and/or located to support the amplifier so that it can be rotated, relative to the frame, between at least a first position and a second position. The first guitar holding hardware set and the amplifier holding hardware set are each connected to the frame so that when an amplifier is present in the amplifier supporting software: (i) the first guitar holding set is located on the first lateral side of the amplifier, and (ii) the first guitar holding set is located on the first lateral side of the amplifier.

According to a further aspect of the present invention, a reconfigurable musical equipment holding system is for use with a first headstock guitar, a second headstock guitar and an amplifier defining a speaker side and first and second lateral sides. The assembly includes: a frame; a first headstock support assembly; a second headstock support assembly; and a first accessory support assembly. The system is reconfigurable between at least a first configuration and a second configuration. The frame includes a first upstanding member and a second upstanding member. The first headstock support assembly includes a first headstock support member and a first connection hardware set. The second headstock support assembly includes a second headstock support member and a second connection hardware set. The first accessory support assembly includes an accessory support member and a third connection hardware set. The first headstock support member is sized, shaped and/or structured to support a guitar headstock against forces of gravity. The second headstock support member is sized, shaped and/or structured to support a guitar headstock against forces of gravity. The first accessory support member is sized, shaped and/or structured to support a musical accessory of a first type against forces of gravity. In the first configuration, the first connection hardware set detachably mechanically connects the first headstock support assembly to the first upstanding member. In the first configuration, the second connection hardware set detachably mechanically connects the second headstock support assembly to the second upstanding member. In the second configuration, the third connection hardware set detachably mechanically connects the first accessory support assembly to the first upstanding member.

BRIEF DESCRIPTION OF THE DRAWINGS

The present invention will be more fully understood and appreciated by reading the following Detailed Description in conjunction with the accompanying drawings, in which:

FIG. 1 is a perspective view of a prior art music stand holding a guitar and an amplifier;

FIG. 2 is an orthographic side view of a first embodiment of a stand according to the present invention;

FIG. 3 is a detail view of a component of the first embodiment stand;

DETAILED DESCRIPTION OF THE INVENTION

Figure 5:
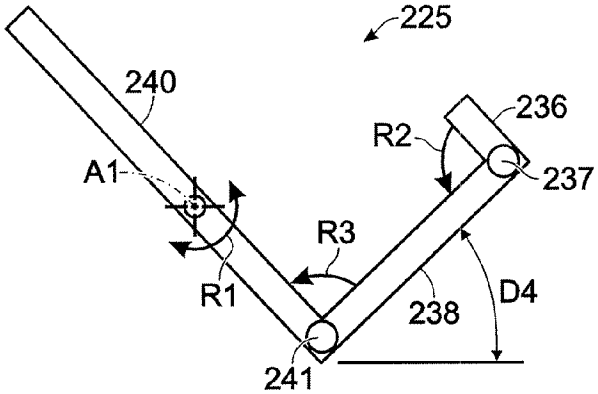
FIG. 5 is an orthographic side view of a portion of the first embodiment stand.
Figure 6:
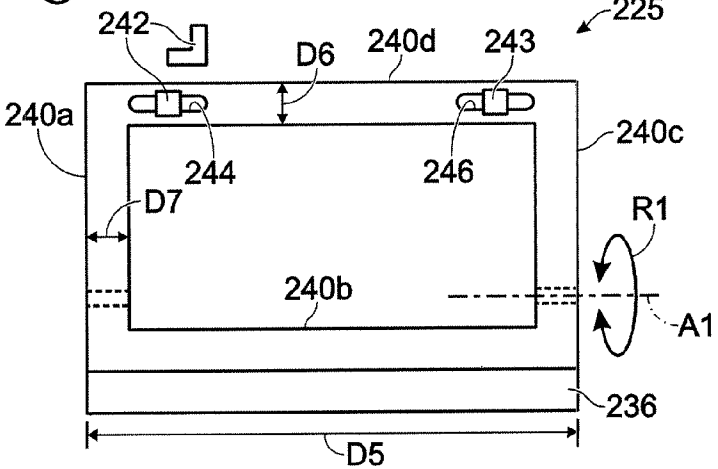
FIG. 6 is an orthographic front view of a portion of the first embodiment stand.
Figure 7:
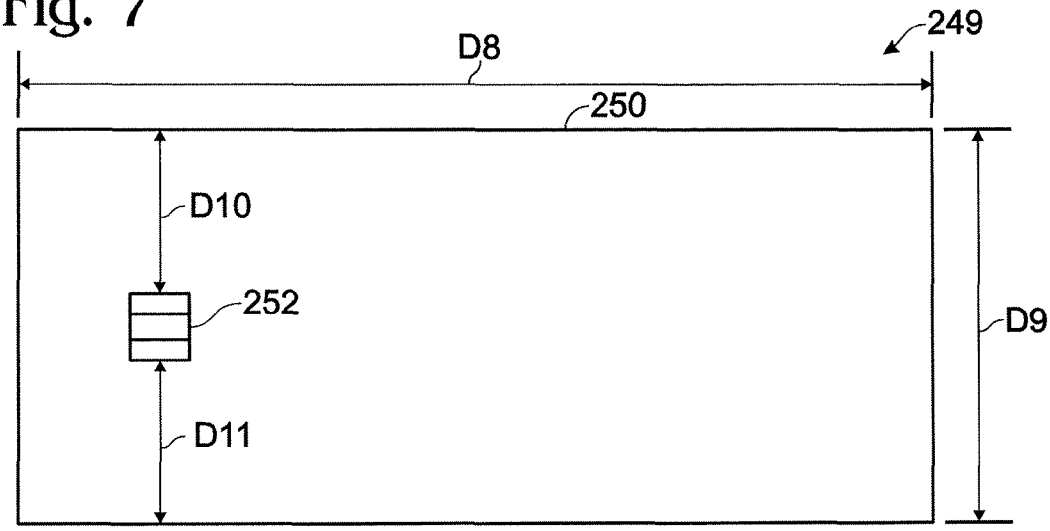
FIG. 7 is an orthographic top view of a removable portion of the first embodiment stand.
Figure 8B:
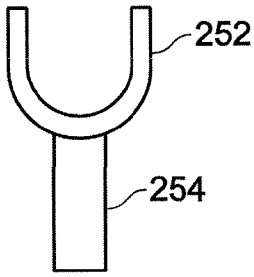
FIG. 8 is an orthographic front view of a portion of the first embodiment stand in a configuration where a removable guitar table is installed.
Figure 8A:
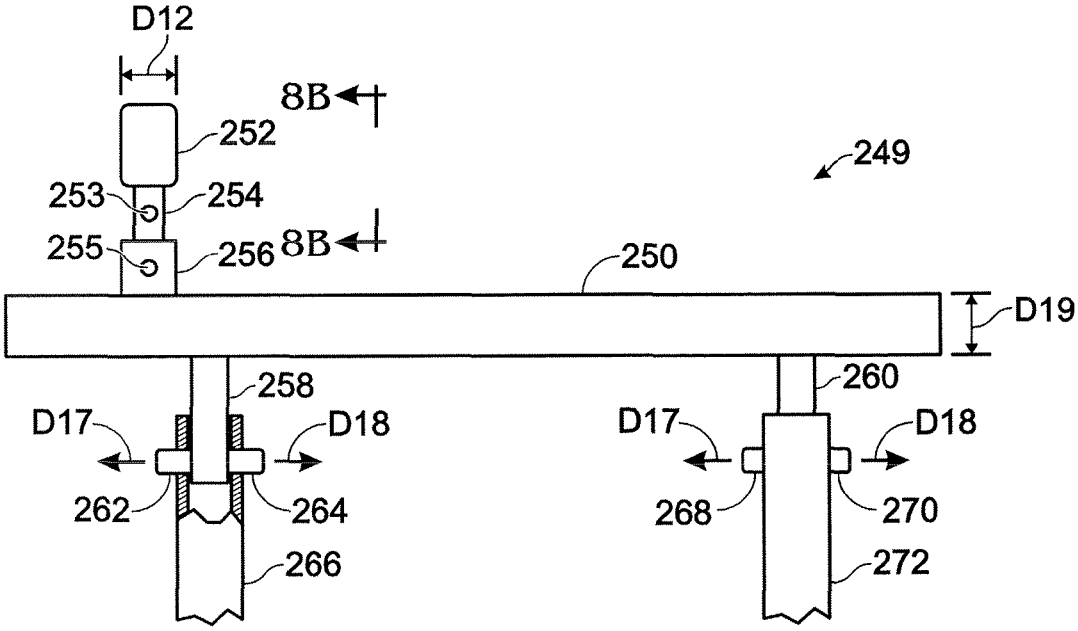
Figure 9:
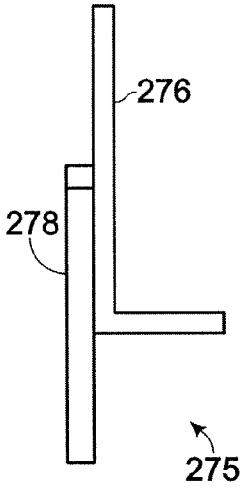
FIG. 9 is an orthographic side view of a removable portion of the first embodiment stand.
Figure 10:
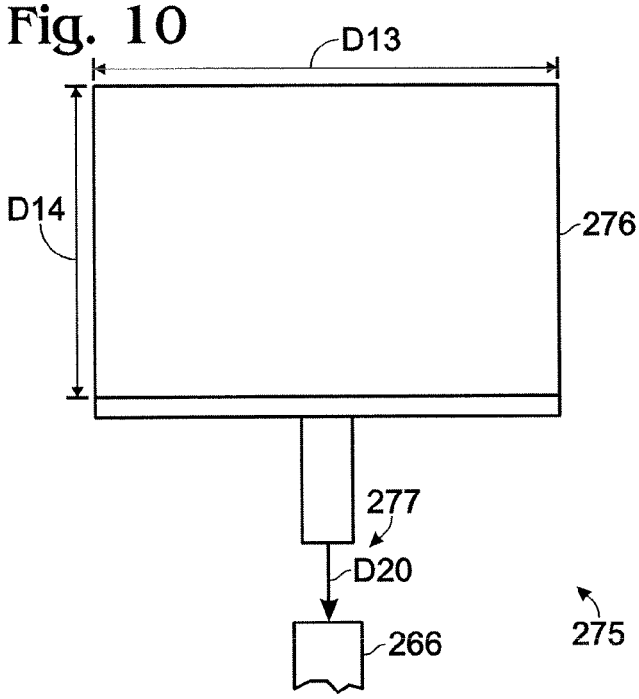
FIG. 10 is an orthographic front view of a removable portion of the first embodiment stand.
Figure 11:
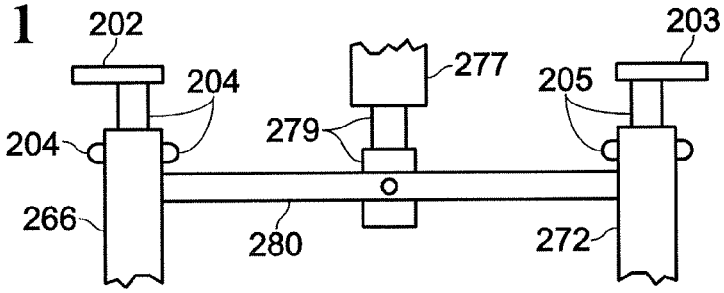
FIG. 11 is an orthographic front view of a portion of the first embodiment stand in a configuration where a music stand assembly is removably installed.
Figure 12:
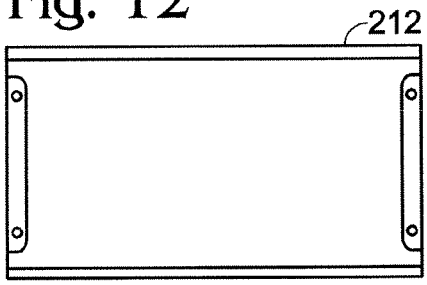
FIG. 12 is an orthographic top view of a portion of the first embodiment stand.
Figure 13:
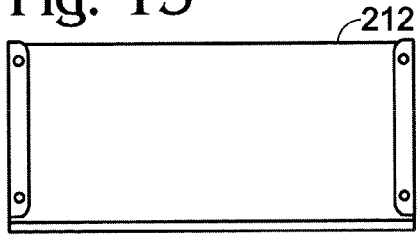
FIG. 13 is an orthographic side view of a portion of the first embodiment stand.

FIGS. 2 to 13 show a music equipment holding system 200 according to the present invention including: frame 201; headstock support members 202, 203; height adjustment assemblies 204, 205; headphone hook 206; aligned holes for receiving rotating connection hardware 208; power strip 210; storage box 212; back pad 214; bottom pad 216; guitar body bottom supports 218, 220; forty-five degree stops 222; zero degree stops 224; holes for receiving bottom support hardware 226; holes for receiving headstock support assembly height adjustment hardware 230; transverse frame member 232; aligned holes for receiving transverse frame member connection hardware 234; amplifier support assembly 225; guitar table assembly 249; sheet music stand assembly 275; holes for receiving box support hardware 227; first upstanding frame member 266; second upstanding frame member 272; and sheet music assembly support frame member 280. As shown in FIGS. 5 and 6, amplifier support assembly includes speaker side support member 236; first lockable hinge 237; bottom side support member 238; rear side support member 240; second lockable hinge 241; adjustable lateral side support members 242, 243; and slots 244, 246. As shown in FIGS. 8A and 8B, guitar table assembly 249 includes: table member 250; U-shaped neck support 252; post 254; biased buttons 255; and post receiving sleeve 256. As shown in FIGS. 9 to 11, sheet music stand assembly 275 includes sheet music support member 276; post 278 (including bottom end 277); and connection hardware assembly 279.

Combination guitar and amplifier stand 200 has the ability to hold two guitars and a single 1×12 or 2×12 combination solid state or tube amplifier. The stand has been designed to hold a single piece of equipment without tipping over.

Each guitar holding hardware set 202, 218 and 203, 219 allows a user to place a guitar so that it is supported be the guitar holding hardware set when not in use. The bottom of the guitar's headstock will rest in a recess defined within padded holder 202 (or 203). The body of the guitar will rest against bottom support 218 (or 219), which is in the form of a padded bar. No additional hardware or accessories are needed to reliably secure the guitar in a generally upright position, up off of the floor. As best shown by the dotted line in FIG. 4, the amplifier is placed in amplifier support assembly, which is located between upstanding posts 266 and 272 of frame 201. No additional hardware or accessories are required to secure the amplifier in place in the amplifier support assembly. FIG. 5 shows how members 236, 238 and 240 support the amplifier. In this preferred embodiment, the angle of the amplifier is adjustable between a 0 degree (horizontal) position and a position where the bottom side of the amplifier is at angle D4 (preferably 45 degrees) from the horizontal. As shown in FIGS. 5 and 6, the amplifier rotates about axis A1 in directions R1. Other embodiments may be continuously adjustable over an angular range. Still other embodiments may not be adjustable at all.

Figure 4:
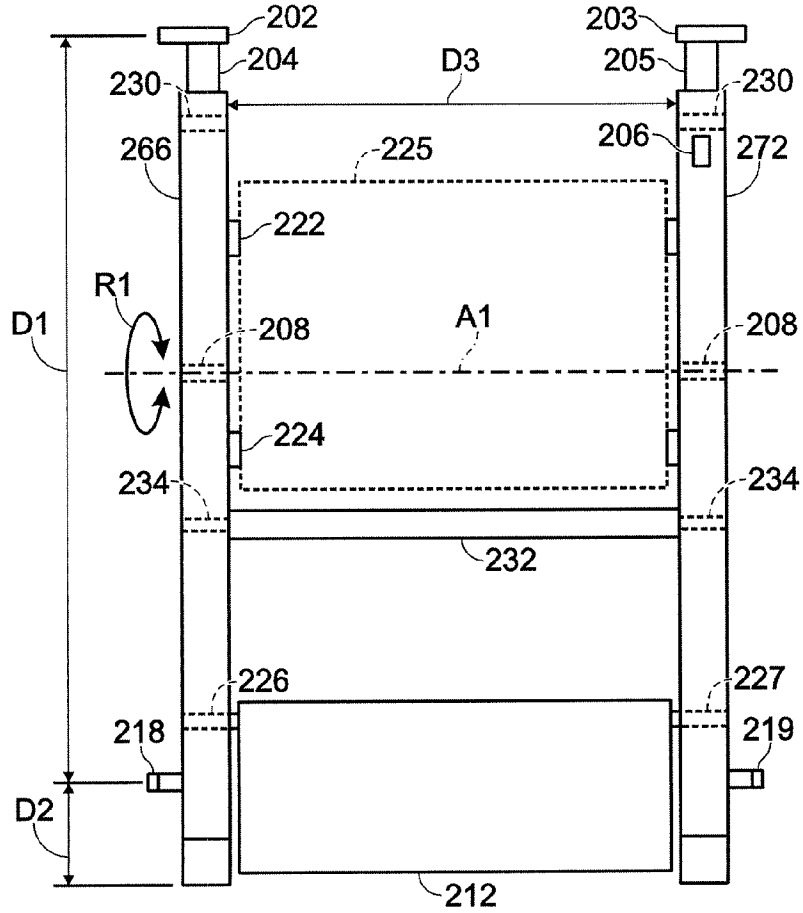
FIG. 4 is an orthographic front view of the first embodiment stand.

As shown in FIGS. 2 and 4, stand 200 includes a storage box 212. This box can hold various accessories, such as foot pedals, cables, power cords, tools and/or cleaning equipment. A UPS power strip 210 may also be installed on one or A-shaped legs of frame 201 (and/or at other locations on the stand), and FIG. 2 shows the stand with the power strip installed. Having the power strip can help the user organize their power cords, and will tend to reduce the power cord length required as the users uses her musical equipment in the vicinity of her stand and amplifier.

Stand 200 is designed to be versatile. For example, headstock support assemblies 202, 203 and their height adjustment assemblies 204, 205 can be removed from the stand, without using any tools, so that upstanding frame members 266, 272 can be used to support a guitar table, as shown in FIGS. 8A and 8B. Also other equipment can be installed atop the upstanding frame members, such as music stands. The guitar table can be used to perform tuning or adjustments on the guitars. The music stands can be used to hold sheet music, notebooks or other books in a position for hands-free reading. It is noted that a different music stand assembly will be discussed below in connection with FIGS. 9 to 11, but this paragraph referred to music stands (not shown) which may be optionally installed atop the upstanding frame members in place of the headstock support assemblies.

As shown in FIG. 2: (i) slots 204*a* in height adjustment assembly allow for adjustment of the distance D1 (see FIG. 4) between the bottom support and headstock support of the guitar holding hardware set by choosing which set of holes 204*a* will be engaged by connection hardware (not shown) at holes 230 in upstanding post 266; and (ii) this height adjustment is useful because acoustic guitars, electric guitars and basses tend to have different body and/or neck lengths.

As shown in FIG. 3, the bottom support member 218 of the guitar holding hardware set forms a sort of shelf to support the bottom of the body of the guitar at a distance of D2 (see FIG. 4) up off of the floor. It is noted that the guitar holding hardware sets of the stand 200 hold the guitar in a generally upright position, which is generally preferred. Member 218 is secured to frame 201 by connection hardware (not shown) at hole 226.

As shown in FIG. 4: (i) D3 is preferably designed to be wide enough to accommodate an amplifier having a 2×12 standard form factor; (ii) in FIG. 4 the stand does not have the optional power strip installed; (iii) stop 222 will support the amplifier support hardware at its angled position (for example, 45 degrees); and (iv) stop 224 will support the amplifier support hardware at its horizontal position (that is, 0 degrees).

Some preferred characteristics of stand 200 will now be mentioned: (i) a single guitar can be held on either lateral side without tipping even when no amplifier is in place; (ii) it is lightweight and easily moveable; (iii) wheels (such as casters) can be added to the bottom; (iv) made of a non-corrosive metal; (v) preferably ½ inch and/or ¾ inch tube stack is used for frame 201; and/or (vi) can hold amplifiers weighing up to 150 pounds.

As shown FIG. 5: (i) a hole in the lateral side of member 240 will determine the pivot axis A1 of the amplifier support assembly and any amplifier installed therein; (ii) this hole placement is a matter of design choice; and (iii) this hole in the lateral side of member is aligned with holes 208 in frame 201 so that connection hardware (not shown) makes a rotatable mechanical connection between the frame and amplifier support assembly 225; (iv) hinge 237 allows member 236 to fold up against member 238 in the R2 direction; and (v) hinge 241 allows member 238 to fold up against member 240 in the R3 direction.

As shown in FIG. 6: (i) dimension D5 is preferably made wide enough to reliably support to support a 1×12/2×12 guitar amplifier; (ii) adjustable sliders sub-assembly 242, 244, 246, 243 can secure the amplifier against movement in the lateral direction by clamping the lateral surfaces of the amplifier (but they may not be needed and/or preferred because gravity and friction will tend to hold the amplifier relative still against lateral direction movement); and (iii) dimensions D6 and D7 are a matter of design choice but they should be made sufficiently small so that any connections (for example, electrical cords) that need be made at the back of the amplifier will not be subject to physical interference by portions 240*a,b,c,d* of member 240, which abuts and supports the rear side of the amplifier.

As shown in FIGS. 7 and 8, a table/work bench can be installed in place of the headstock support members on top of the upstanding frame members 266, 272. In this embodiment, the stand can be used to secure two guitars or used as a work table, but it cannot perform both functions at the same time because the same two upstanding frame members are used to hold both the headstock supports and the table assembly. Other embodiments of the present invention may provide a stand that can act as work table, and still hold one of more guitars (in the upright position, not on the work table), but this may be less space efficient and may cause the stand to be less easy to move and/or work around within the confines of a studio. As shown in FIGS. 7 and 8: (i) neck support 252 provides support for the neck of the guitar so that it will not lie flat on the table, but rather be somewhat inclined from the horizontal; (ii) first and second table mounting sub-assemblies 258, 260 removably secure table assembly 249 to the rest of stand 200; (iii) more specifically, biased buttons 262, 264, 268, 270 are spring biased (springs not shown) in the outward directions D17, D18 and they can be temporarily forced into a compressed position for insertion of the mounting sub-assemblies into the upstanding frame members, but then allowed to again move outwards to engage aligned holes 230 (see FIG. 4) and thereby secure the table; (iv) similar biased buttons 253, 255 may be used on post 254 to secure the neck support and the post inside of sleeve 256; (v) there are more than one vertically spaced-apart set of biased buttons 253, 255 on post 254 in order to allow height adjustment of the neck support by choosing which set of buttons, 253 or 255, will engage with sleeve 256; (vi) multiple sets of vertically spaced apart outwards-biased buttons could likewise be provided on height adjustment assemblies 204, 205 in order to provide for height adjustment of the headstock supports when the stand is used as an upright guitar holding device rather than a guitar table; (vii) as will be appreciated by those of skill in the art, dimensions D8, D9, D10, D11, D12 and D19 are a matter of design choice; and (viii) neck support 252 is preferably curved and has rubber padding to avoid scratching or damage to the necks of a wide variety of guitars that may be tuned on the table.

As shown in FIG. 9, sheet music support member 276 should preferably be able to rotate in all directions in three space relative to post 278. For example, this type of movable connection is conventionally achieved in music stands by the use of a ball sphere connection hardware set. As shown in FIG. 10: (i) dimension D13 is preferably 18 inches; (ii) dimension D14 is preferably 12 inches; and (iii) music stand assembly 275 may be installed on the rest of stand 200 by inserting bottom end 277 of post 278 down, in the D20 direction, into the top of upstanding frame member 266 (or 272) once the headstock support member has been removed. As shown in FIG. 11, another way to add a music stand assembly is to: (i) secure sheet music assembly support frame member 280 across upstanding support members 266 and 272; (ii) secure connection hardware assembly 279 to member 280; and (iii) insert bottom end 277 of post 278 of music stand assembly 275 into assembly 279.

Figure 14:
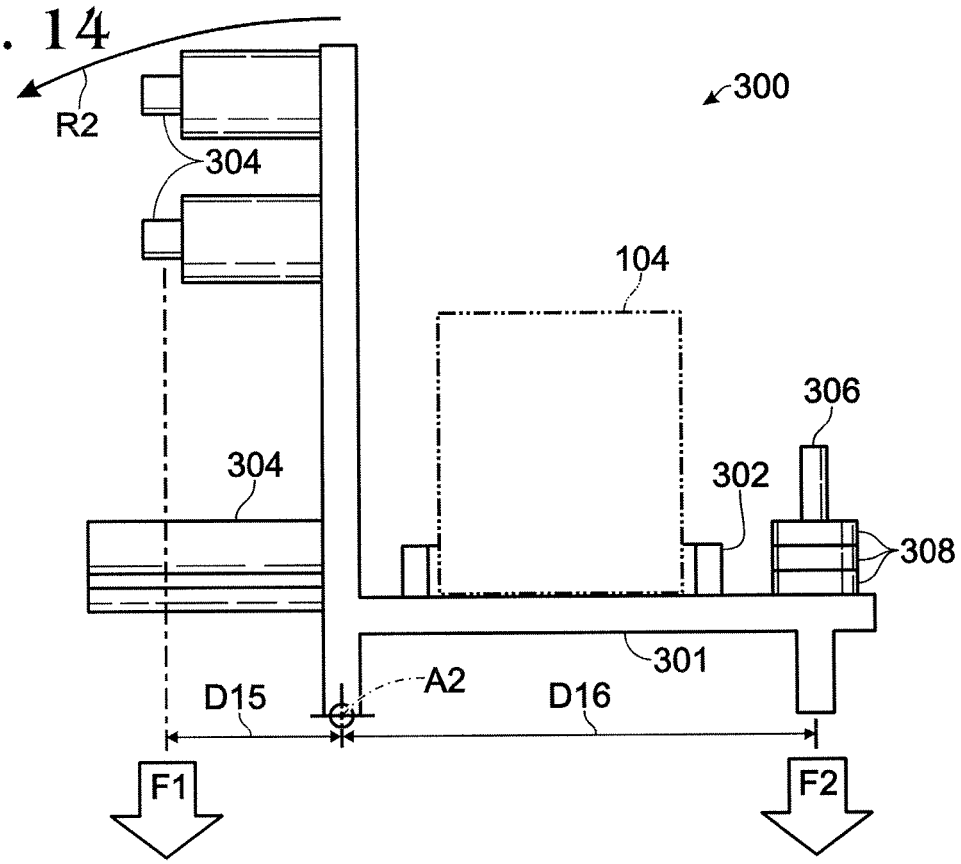
FIG. 14 is an orthographic front view of a second embodiment of a stand according to the present invention with dashed lines to show where an amplifier can be supported.
Figure 15:
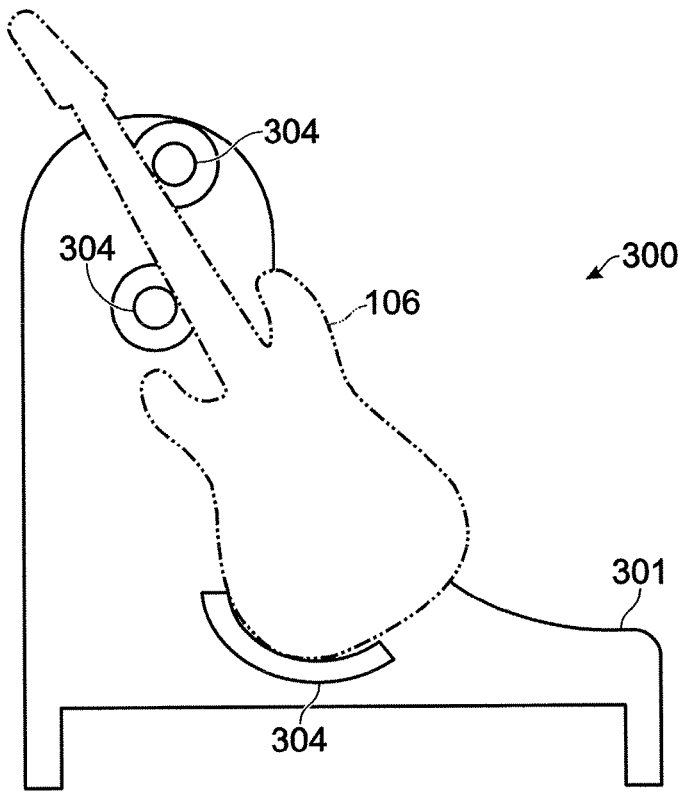
FIG. 15 is an orthographic side view of the second embodiment stand shown with a guitar being supported by the stand.

FIGS. 14 to 15 show a combination guitar and amplifier stand 300 for use with guitar 106 and amplifier 104. Stand 300 is not a preferred embodiment of the present invention, but is presented to more clearly show some of the operating principles underlying the present invention and also to show some of the potential broad scope that the present invention may have. Stand 300 includes: frame 301; guitar support hardware set 304; amplifier support hardware set 302; ballast post 306; and ballast weights 308. It is noted that this embodiment holds only a single guitar. It is noted that the guitar is not supported by the headstock and not supported in the generally upright positions. Generally speaking, these characteristics are not preferred, but there may be good reasons to use designs having these characteristics for some applications.

FIG. 14 is shown without the guitar in place, but vector F1 shows that force that the guitar will exert on the stand when it is in place. This force acts at distance D15 from tipping point A2 and will create a torque that tends to tip the stand in rotational direction R2. When the guitar is resting in the stand, its torque is equal to the product of the weight of guitar 106 and the length of moment arm D15. In this embodiment the guitar is cantilevered at a relatively large distance D15 for some reason, although this is generally not preferred because it increases tipping torque. It is also noted that if someone presses down on the guitar (for example, if it is bumped by a dog), then the torque will temporarily increase, thereby increasing the tendency to tip in the R2 direction about the A2 axis.

However, with stand 300, this torque created by the guitar is overborne by a torque created by ballast weights 308 so that tipping in the R2 direction about axis A2 will not occur. As shown in FIG. 14, the torque created by the ballast is the magnitude of vector F2 (that is, the weight of the ballast) multiplied by the length of moment arm D16.

Now, while it is not necessarily preferred to use ballast to create the stabilizing torque, this example does show how other, more preferred, embodiments of the present invention inherently resist tipping by design. One reason is that when an amplifier is in place, the weight of the amplifier will act as ballast. At a more subtle level, because the guitar support hardware is at a lateral side of the amplifier support hardware, this means that frame 301 must extend across the width of the speaker side of an amplifier (see FIG. 14 at phantom line 104, showing this width). Because the frame extends in this direction, the weight of the frame itself will act as a ballast to counter tipping torque. This remains true even when no guitar and no amplifier are in place, and only a single guitar is supported by the otherwise-empty frame. The weight of the frame at the opposite end from the end where the guitar is supported because this weight has a moment arm length that is greater than the width of the speaker side of an amplifier. This relatively large moment arm helps a given amount of frame weight to provide maximum stability by balancing out the tipping torque of the guitar.

DEFINITIONS

Any and all published documents mentioned herein shall be considered to be incorporated by reference, in their respective entireties. The following definitions are provided for claim construction purposes:

Present invention: means "at least some embodiments of the present invention," and the use of the term "present invention" in connection with some feature described herein shall not mean that all claimed embodiments (see DEFINITIONS section) include the referenced feature(s).

Embodiment: a machine, manufacture, system, method, process and/or composition that may (not must) be within the scope of a present or future patent claim of this patent document; often, an "embodiment" will be within the scope of at least some of the originally filed claims and will also end up being within the scope of at least some of the claims as issued (after the claims have been developed through the process of patent prosecution), but this is not necessarily always the case; for example, an "embodiment" might be covered by neither the originally filed claims, nor the claims as issued, despite the description of the "embodiment" as an "embodiment."

First, second, third, etc. ("ordinals"): Unless otherwise noted, ordinals only serve to distinguish or identify (e.g., various members of a group); the mere use of ordinals shall not be taken to necessarily imply order (for example, time order, space order).

Mechanically connected: Includes both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, quick-release connections, latches and/or magnetic connections), force fit connections, friction fit connections, connections secured by engagement caused by gravitational forces, pivoting or rotatable connections, and/or slidable mechanical connections.

Guitar: any musical instrument having a elongated neck and instrument body located at an end of the elongated neck; guitars include, but not necessarily limited to, acoustic guitars, bass guitars, electric guitars, banjos, mandolins, guitar-style keyboards, video game guitars having no strings, violins, cellos, violas, etc.

headstock guitars: guitars that further include a headstock.

regular guitars: electric guitars (as that term is commonly understood), electric basses (as that term is commonly understood) and acoustic guitars (as that term is commonly understood); includes, but is not limited to: fretless basses, five string basses, double necked guitars, etc.

amplifier: an electronic amplifier designed to make the signal of an electric instrument louder so that it will produce sound through a loudspeaker; "amplifiers" may also modify the instrument's tone by emphasizing or de-emphasizing certain frequencies and adding electronic effects, but this is not necessarily required.

Unless otherwise explicitly provided in the claim language, steps in method or process claims need only be performed that they happen to be set forth in the claim only to the extent that impossibility or extreme feasibility problems dictate that the recited step order be used. This broad interpretation with respect to step order is to be used regardless of alternative time ordering (that is, time ordering of the claimed steps that is different than the order of recitation in the claim) is particularly mentioned or discussed in this document. Any step order discussed in the above specification, and/or based upon order of step recitation in a claim, shall be considered as required by a method claim only if: (i) the step order is explicitly set forth in the words of the method claim itself; and/or (ii) it would be substantially impossible to perform the method in a different order. Unless otherwise specified in the method claims themselves, steps may be performed simultaneously or in any sort of temporally overlapping manner. Also, when any sort of time ordering is explicitly set forth in a method claim, the time ordering claim language shall not be taken as an implicit limitation on whether claimed steps are immediately consecutive in time, or as an implicit limitation against intervening steps.

What is claimed is:

1. A musical equipment holding assembly for use with a first headstock guitar, a second headstock guitar and an amplifier defining a speaker side, top and bottom sides, and first and second lateral sides, the assembly comprising:

a frame comprising a first frame member and a second frame member;

said first frame member comprising a first triangular-shaped base comprising a first apex extending in a first plane, and a first upstanding member extending within said first plane from said first apex, said second frame member comprising a second triangular-shaped base comprising a second apex extending in a second plane parallel to the first plane, and a second upstanding member extending within said second plane from said second apex;

a first guitar holding hardware set connected to said first frame member;

a second guitar holding hardware set connected to said second frame member; and an amplifier holding hardware set;

wherein:

the first guitar holding hardware set comprises a first headstock support member and a first bottom support member;

the first guitar holding hardware set is sized, shaped, structured and/or located to support the first guitar in a generally upright position;

the second guitar holding hardware set comprises a second headstock support member and a second bottom support member;

the second guitar holding hardware set is sized, shaped, structured and/or located to support the second guitar in a generally upright position;

the amplifier holding hardware set is sized, shaped, structured and/or located to support the amplifier so that it can be rotated, relative to the frame, between at least a first position and a second position; and the first guitar holding hardware set and the amplifier holding hardware set are each connected to the frame so that when an amplifier is present in the amplifier supporting software: the first guitar holding set is located on the first lateral side of the amplifier.

2. The assembly of claim 1 wherein:

the first guitar holding hardware set further comprises a first connection hardware set;

the first connection hardware set is sized, shaped, structured and/or located to mechanically connect the first headstock support member to the frame so that it may be adjusted between at least a third position and a fourth position, with the third position of the first headstock support member being closer to the bottom support than the fourth position of the first headstock support member;

the second guitar holding hardware set further comprises a second connection hardware set; and the second connection hardware set is sized, shaped, structured and/or located to mechanically connect the second headstock support member to the frame so that it may be adjusted between at least a fifth position and a sixth position, with the fifth position of the first headstock support member being closer to the bottom support than the sixth position of the second headstock support member.

3. The assembly of claim 1 further comprising a storage box wherein the storage box is mechanically connected to the frame between the first guitar holding hardware set and the second guitar holding hardware set.

4. The assembly of claim 1 further comprising a power strip wherein the power strip is mechanically connected to the frame between the first guitar holding hardware set and the second guitar holding hardware set.

5. The assembly of claim 1 wherein:

the amplifier connection hardware comprises rotating connection hardware, an amplifier bottom support member, an amplifier rear side support member and a first hinge;

the rotating connection hardware is located, connected and/or structured so that the amplifier bottom support member and the amplifier rear side support member can rotate, relative to the frame, between the first position and second position; and the first hinge mechanically connects the amplifier bottom support member to the amplifier rear side support member so that the amplifier bottom support member can rotate, relative to the amplifier rear side support member between an open position and a folded position.

6. The assembly of claim 1 further comprising a headphone hook wherein the headphone hook is mechanically connected to the frame between the first guitar holding hardware set and the second guitar holding hardware set.

7. The assembly of claim 1 further comprising a music stand sub-assembly mechanically connected to the frame between the first guitar holding hardware set and the second guitar holding hardware set.

8. The assembly of claim 1 further comprising a power strip wherein the power strip is mechanically connected to the frame.

9. A reconfigurable musical equipment holding system for use with a first headstock guitar, a second headstock guitar and an amplifier defining a speaker side, top and bottom sides, and first and second lateral sides, the assembly comprising:

a frame comprising a first frame member and a second frame member;

said first frame member comprising a first triangular-shaped base comprising a first apex extending in a first plane, and a first upstanding member extending within said first plane from said first apex, said second frame member comprising a second triangular-shaped base comprising a second apex extending in a second plane parallel to the first plane, and a second upstanding member extending within said second plane from said second apex;

a first guitar holding hardware set connected to said first frame member;

a second guitar holding hardware set connected to said second frame member; and an first accessory support assembly;

wherein:

the system is reconfigurable between at least a first configuration and a second configuration;

the first headstock support assembly comprises a first headstock support member and a first connection hardware set;

the second headstock support assembly comprises a second headstock support member and a second connection hardware set;

the first accessory support assembly comprises an accessory support member and a third connection hardware set;

the first headstock support member is sized, shaped and/or structured to support a guitar headstock against forces of gravity on the first lateral side of the amplifier;

the second headstock support member is sized, shaped and/or structured to support a guitar headstock against forces of gravity;

the first accessory support member is sized, shaped and/or structured to support a musical accessory of a first type against forces of gravity;

in the first configuration, the first connection hardware set detachably mechanically connects the first headstock support assembly to the first upstanding member;

in the first configuration, the second connection hardware set detachably mechanically connects the second headstock support assembly to the second upstanding member; and in the second configuration, the third connection hardware set detachably mechanically connects the first accessory support assembly to the first upstanding member.

10. The system of claim 9 further comprising amplifier holding hardware, wherein:

the amplifier holding hardware is mechanically connected to the frame between the first upstanding member and the second upstanding member; and the amplifier holding hardware set is sized, shaped, structured and/or located to support an amplifier against the forces of gravity.

11. The system of claim 9 wherein:

the first accessory support assembly further comprises a table member, a neck support sub-assembly and a fourth hardware connection set;

in the second configuration, the fourth connection hardware set detachably mechanically connects the first accessory support assembly to the second upstanding member; and the neck support sub-assembly and the table member are designed so that a guitar can be supported in a generally horizontal, but inclined, position by the table member and the neck support sub-assembly when the system is in the second configuration.

12. The system of claim 11 wherein:

the neck support sub-assembly comprises a neck support member, height adjustment hardware and a fifth connection hardware set;

the fifth connection hardware set mechanically connects the neck support sub-assembly to the table member; and the height adjustment hardware is structured, located, sized, shaped and/or connected to allow a user to adjust the neck support sub-assembly between at least a first position and a second position, with a distance between the neck support member and the table member being less in the first position than in the second position.

13. The system of claim 11 further comprising a second accessory support subassembly, wherein:

the system is further configurable in a third configuration;

the second accessory support assembly further comprises a first music stand sub-assembly and a fifth hardware connection set;

the first music stand sub-assembly is sized, shaped, connected and/or structured to support sheet music against the forces of gravity; and in the third configuration, the third connection hardware set detachably mechanically connects the second accessory support assembly to the first upstanding member.

14. The system of claim 9 wherein:

the first accessory support assembly further comprises a first music stand sub-assembly; and the first music stand sub-assembly is sized, shaped, connected and/or structured to support sheet music against the forces of gravity.

15. The assembly of claim 9 further comprising a storage box wherein the storage box is mechanically connected to the frame.

16. The assembly of claim 9 further comprising a headphone hook wherein the headphone hook is mechanically connected to the frame.

* * * * *